United States Patent [19]

Sibert

[11] Patent Number: 4,511,787

[45] Date of Patent: Apr. 16, 1985

[54] ELECTRIC STOVE PIPE SPACE HEATER

[76] Inventor: Frank Sibert, 135-D High Point Blvd., Boynton Beach, Fla. 33435

[21] Appl. No.: 442,774

[22] Filed: Feb. 2, 1983

Related U.S. Application Data

[63] Continuation-in-part of Ser. No. 333,384, Dec. 22, 1981, abandoned.

[51] Int. Cl.[3] ..... F24H 3/04; F24H 9/00

[52] U.S. Cl. ..... 219/374; 219/366; 219/367; 219/377

[58] Field of Search ..... 219/374, 377, 361, 366, 219/367, 381, 342, 346, 373; 126/99 A, 109

[56] References Cited

U.S. PATENT DOCUMENTS

| | | | |
|---|---|---|---|
| D. 256,273 | 8/1980 | Townsend et al. | D23/124 |
| D. 256,501 | 8/1980 | Glucksman | D23/122 |
| 569,278 | 10/1896 | Fraley | 219/366 |
| 1,052,997 | 2/1913 | Barstow | 219/374 |
| 1,533,098 | 4/1925 | Carmean et al. | 219/369 |
| 1,660,052 | 2/1928 | Shepherd | 219/366 |
| 1,709,223 | 4/1929 | Lyon | 219/366 |
| 1,726,337 | 8/1929 | Brown | 219/377 |
| 1,755,204 | 4/1930 | Buffalow et al. | 219/374 |
| 1,828,809 | 10/1931 | Landis | 219/342 |
| 1,901,038 | 3/1933 | Marshall | 219/366 |
| 2,353,247 | 7/1944 | Kuettel | 219/374 |
| 2,456,881 | 12/1948 | Leather | 219/366 |
| 2,486,309 | 10/1949 | McIntosh . | |
| 2,522,860 | 9/1950 | Conaway | 219/366 |
| 3,138,699 | 6/1964 | Taylor | 219/345 |
| 3,180,972 | 4/1965 | Covault | 219/374 |
| 3,245,396 | 4/1966 | Goss | 126/109 |
| 3,388,697 | 6/1968 | Muckelrath | 126/109 |
| 3,407,284 | 10/1968 | Prata | 219/374 |
| 3,418,452 | 12/1968 | Grabner | 219/370 |
| 3,486,002 | 12/1969 | Eno et al. | 219/367 |
| 3,998,188 | 12/1976 | Priest et al. | 126/109 |

FOREIGN PATENT DOCUMENTS

| | | | |
|---|---|---|---|
| 238842 | 3/1965 | Austria | 219/346 |
| 721657 | 11/1930 | France | 219/367 |
| 237938 | 10/1943 | Switzerland | 219/366 |
| 766533 | 1/1957 | United Kingdom | 219/374 |

OTHER PUBLICATIONS

"King Baseboard Heaters".

*Primary Examiner*—Roy N. Envall, Jr.
*Assistant Examiner*—G. Evans
*Attorney, Agent, or Firm*—Richard M. Goldberg

[57] ABSTRACT

An electric space heater includes an elongated horizontally-disposed hollow metal pipe having opposite open ends and a bottom portion with a longitudinally extending opening; support legs for supporting the pipe at its opposite ends above a surface; an electric heating element mounted substantially centrally within the pipe at the bottom portion; and an electric cord for supplying electricity to the electric heating element to control the latter to heat the ambient atmosphere by radiation from the pipe and by forced air convection through the opposite open ends.

5 Claims, 2 Drawing Figures

ELECTRIC STOVE PIPE SPACE HEATER

REFERENCE TO RELATED APPLICATION

This application is a continuation-in-part application of U.S. design patent application Ser. No. 333,384, by the same applicant, filed Dec. 22, 1981, entitled Electric Stove Pipe Space Heater, now abandoned.

BACKGROUND OF THE INVENTION

The need for cheap heat is increasing in this country and other countries worldwide due to the excessive cost of fuel oil, gas, electricity, coal and wood and the growing population.

Apartment house owners suffer too. For example, if 30 gallons oil per hour are used to heat 30 apartments, with 120 rooms, average 4 rooms per apt., the cost is \$30./hr @ \$1./gal, that is, \$1./apt/hr.

| | | 300 hrs per month |
|---|---|---|
| Fuel Oil Costs | 25¢/hr/room | \$75.00/month/room |
| Gas @ 55¢/T Costs | 11¢/hr/room | 33.00/month/room |
| 1500 Watts Elec Costs | 13¢/hr/room | 39.00/month/room |
| Stove Pipe Heater | 6¢/hr/room | 18.00/month/room |
| *Stove Pipe Heater | 2½¢/hr/room | 7.50/month/room |

*actual cost for first heating an 18 × 15 ft. living room & open dinette and then opening a door to a cold 15 × 15 bedroom which was also heated.
Above electric costs based on 9¢ per KWHR in East Orange, N.J.

It is to be appreciated that conventional electric heaters are also not economical. For example, to heat the same 2½ room area as above, it is required that two 1500 Watt electric heaters, each with a fan, be used at a cost of 26¢ per hour.

SUMMARY OF THE INVENTION

The present invention provides a new electric Stove Pipe heater having an efficiency far greater than the 1500 watt electric heaters with fans discussed above which are very costly at 26¢ per hour. With the new type heater according to the present invention, the same room area (2½ rooms) can be heated for 6¢ per hour and the heater produces cheap direct heat in approximately 20 seconds with substantially no waste heat. In accordance with this invention, a full length opening in the bottom of the pipe allows cold air to enter into the full length single heat chamber by convection, which forces the hot air out of both ends of the pipe and radiates heat from the entire outer surface of the pipe.

The electricl Stove Pipe Heater according to the present invention is a source of direct heat because of convection and radiated heat from the entire outer surface of the pipe and thereby has greater heating efficiency, does not require a fan and thereby heats continously evenly, and silently and costs less to heat the same area than conventional electric heaters. During testing it was discovered that the aforementioned two 1500 Watt heaters with fans were creating a temperature differential of 8° to 20° between the ceiling level and floor level. On the other hand, the temperature difference between ceiling level and floor level was only approximately 1° using the Stove Pipe Heater of this invention. Accordingly, the present heater maintains the heat at floor and chair level where it is needed. Further, in accordance with this invention, the electric stove pipe heater will not burn materials that come into contact with the pipe during operation, even during extended periods of operation. For example, with a toilet tissue laid horizontally across the stove pipe for a few hours of operation, the toilet tissue will not scorch.

DETAILED DESCRIPTION OF A PREFERRED EMBODIMENT

Figure 1:
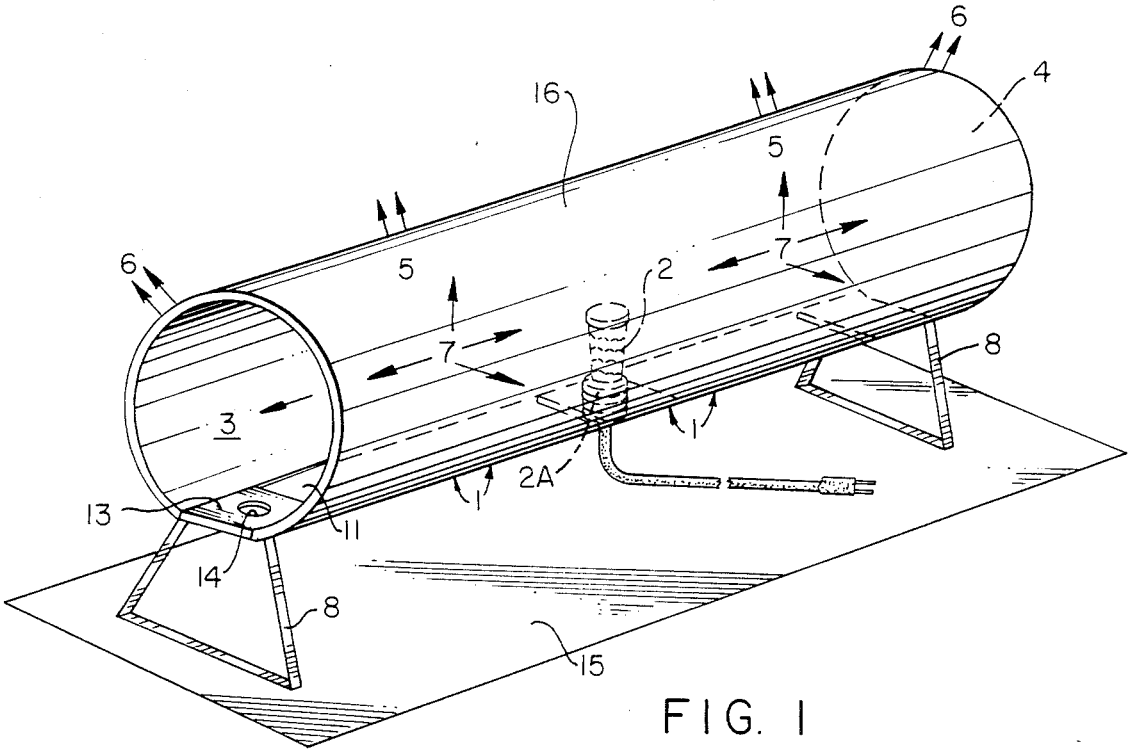
FIG. 1 is a schematic perspective view, partially in phantom, of the heater according to the present invention.
Figure 2:
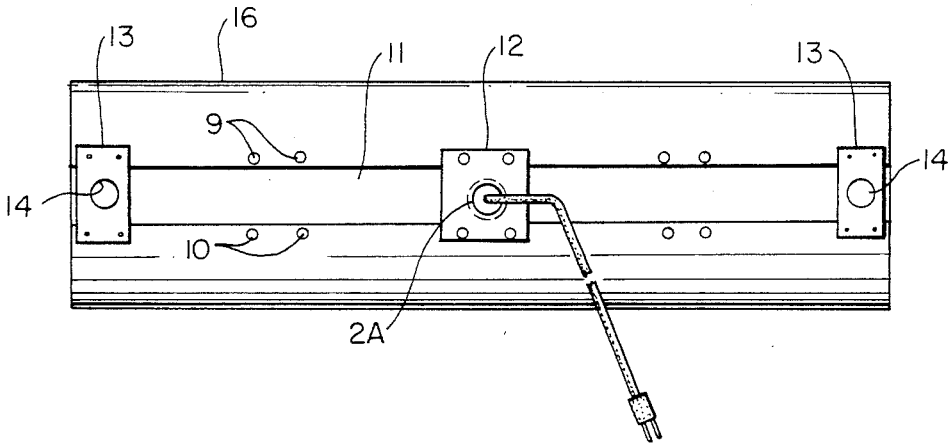
FIG. 2 is a schematic bottom plan view of the heater of FIG. 1 with the legs removed.

Referring to the drawings in detail, and initially to FIG. 1 thereof, the electric stove pipe heater according to the present invention includes an elongated horizontally-disposed hollow metal pipe 16 having opposite open ends 3 and 4, respectively. As shown in FIG. 2, the pipe 16 is cut along a longitudinal line thereof so as to define an elongated longitudinal opening 11 at the bottom of the heat pipe and extending along the entire length thereof. The opposite ends of the cut-away portion at the bottom are held a spaced distance apart by means of end plates 13 and central holder plate 12 so as to define bottom opening 11. Each of end plates 13 and central holder plate 12 may include a central aperture 14 therein.

A one piece removable electric heating element 2 having substantially a frusto-conical configuration is removably connected to an electric socket 2A having a cord extending from the opposite end thereof out of pipe 16, electric socket 2A being mounted on central holder plate 12 such that electric heating element 2 is secured to the bottom of pipe 16 and substantially centrally within the pipe. As an example, electric heating element 2 can be 660 watt, 6 amp, 115 volt heating element.

Additional holes 9 and 10 can be provided on opposite sides of bottom opening 11 within pipe 16 for additional plates.

The pipe 16 is supported above the floor surface by means of support legs 8 secured at the ends of the pipe.

In operation, heat is efficiently radiated throughout a room as follows: First, air within pipe 16 is heated by heating element 2 and by convection, the heated air exists through the opposite open ends 3 and 4 of the pipe. Because of such convection, cooler air is pulled into the interior of pipe 16 through bottom opening 11, as indicated by numeral 1 in FIG. 1 to replace the hot air which exits from the opposite open ends 3 and 4. Additionally, pipe 16 transfers heat to the ambient atmosphere by radiation from the metal pipe 16 itself, as indicated by numerals 5–7 in FIG. 1. In other words, the entire outer surface of heat pipe 16 radiates heat to the ambient atmosphere.

What I claim is:

1. An electric space heater comprising:

an elongated horizontally-disposed cylindrical hollow metal pipe having opposite open ends and a bottom portion with a longitudinally extending opening substantially extending along the entire length of said hollow metal pipe for allowing air to be heated to enter into said pipe;

support means for supporting said pipe above a surface;

an electric heating element mounted substantially equidistant from both ends of said pipe at said bottom portion; and means for supplying electricity to said electric heating element to enable said heating element to heat the pipe by radiation and the ambient atmosphere by convection.

2. An electric space heater according to claim 1; in which said support means includes support legs at opposite ends of the hollow metal pipe.

3. An electric space heater according to claim 1, further including at least one plate for connecting opposite end edges of said pipe which define said longitudinally extending opening.

4. An electric space heater according to claim 3; in which said at least one plate includes at least one end plate and a central holder plate.

5. An electric space heater according to claim 4; in which said means for supplying electricity includes socket means mounted to said central holder plate for removably mounting said electric heating element substantially centrally within the pipe at the bottom portion, said socket means including an electric cord for supplying electricity through said socket means to said electric heating element.

* * * * *